US008886092B2

(12) United States Patent
Saito et al.

(10) Patent No.: US 8,886,092 B2
(45) Date of Patent: Nov. 11, 2014

(54) ELECTROPHOTOGRAPHIC APPARATUS AND PROCESS CARTRIDGE

(75) Inventors: Yoshihisa Saito, Toride (JP); Shoji Amamiya, Yokohama (JP); Hideki Ogawa, Moriya (JP); Tatsuya Ikezue, Toride (JP); Kan Tanabe, Toride (JP); Mayumi Oshiro, Abiko (JP); Kumiko Takizawa, Saitama (JP); Takahiro Mitsui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 13/133,260

(22) PCT Filed: Dec. 3, 2009

(86) PCT No.: PCT/JP2009/070629
§ 371 (c)(1),
(2), (4) Date: Jun. 7, 2011

(87) PCT Pub. No.: WO2010/067832
PCT Pub. Date: Jun. 17, 2010

(65) Prior Publication Data

US 2011/0243603 A1 Oct. 6, 2011

(30) Foreign Application Priority Data

Dec. 8, 2008 (JP) ..... 2008-312377

(51) Int. Cl.

| | |
|---|---|
| ***G03G 15/00*** | (2006.01) |
| ***G03G 9/097*** | (2006.01) |
| ***G03G 5/047*** | (2006.01) |
| ***G03G 5/147*** | (2006.01) |

(52) U.S. Cl.

CPC ..... *G03G 9/09725* (2013.01); *G03G 9/09708* (2013.01); *G03G 5/047* (2013.01); *G03G 9/09716* (2013.01); *G03G 2215/00957* (2013.01); *G03G 5/147* (2013.01); *G03G 15/751* (2013.01)

USPC ..... 399/159

(58) Field of Classification Search

USPC ..... 399/159, 161

See application file for complete search history.

(56) References Cited

U.S. PATENT DOCUMENTS

2007/0254232 A1* 11/2007 Kawahara et al. ..... 430/119.71
2007/0281239 A1 12/2007 Uematsu (Continued)

FOREIGN PATENT DOCUMENTS

EP 1983374 A1 10/2008
EP 1983376 A1 10/2008

(Continued)

*Primary Examiner* — Walter L Lindsay, Jr.
*Assistant Examiner* — Frederick Wenderoth
(74) *Attorney, Agent, or Firm* — Canon U.S.A., Inc., IP Division

(57) ABSTRACT

An electrophotographic apparatus and a process cartridge include an electrophotographic photosensitive member; a developing unit; and a cleaning unit, wherein depressed portions separated from each other and satisfying conditions below are formed in the surface of the electrophotographic photosensitive member at a density of 10 or more per unit area of 1 $cm^2$: a depth of the depressed portions is defined as Rdv[μm], a minor-axis diameter of the depressed portions is defined as Lpc[μm], a major-axis diameter of the depressed portions is defined as Rpc[μm], and an angle formed between a direction of a major-axis of each of the depressed portions and a direction of movement of the surface of the electrophotographic photosensitive member is defined as θ[°].

$5[°] \leq \theta[°] \leq 85[°]$ $0.3 \times P[\mu m] \leq Rdv[\mu m] \leq 0.5 \times P[\mu m]$ $1.1 \times P[\mu m] \leq Lpc[\mu m] \leq 1.5 \times P[\mu m]$ $50/\sin\theta[\mu m] \leq Rpc[\mu m] \leq 1500[\mu m]$

4 Claims, 10 Drawing Sheets

(56) References Cited

U.S. PATENT DOCUMENTS

| | | | | |
|---|---|---|---|---|
| 2008/0019735 | A1 | 1/2008 | Ogaki | |
| 2008/0124126 | A1 | 5/2008 | Anezaki | |
| 2008/0124637 | A1 | 5/2008 | Uematsu | |
| 2009/0074460 | A1 * | 3/2009 | Tanabe et al. | 399/159 |

FOREIGN PATENT DOCUMENTS

| | | | |
|---|---|---|---|
| JP | 2-257145 | A | 10/1990 |
| JP | 2001-066814 | A | 3/2001 |
| JP | 2007-233354 | A | 9/2007 |
| JP | 2007-233356 | A | 9/2007 |
| JP | 2007-233357 | A | 9/2007 |
| JP | 2007-233359 | A | 9/2007 |
| JP | 2009-025627 | A | 2/2009 |
| WO | 2007/088995 | A | 8/2007 |
| WO | 2009/014262 | A | 1/2009 |

* cited by examiner

ELECTROPHOTOGRAPHIC APPARATUS AND PROCESS CARTRIDGE

TECHNICAL FIELD

The present invention relates to an electrophotographic apparatus and a process cartridge.

BACKGROUND ART

In general, an electrophotographic photosensitive member is used in an electrophotographic process including a charging step, an exposing step, a developing step, a transferring step, a cleaning step, and the like. In such an electrophotographic process, an electrostatic latent image formed on the surface of an electrophotographic photosensitive member is developed with a toner contained in a developing unit to thereby form a toner image on the surface of the electrophotographic photosensitive member. The toner image is then transferred from the surface of the electrophotographic photosensitive member to a transfer material with a transferring unit. However, even after the toner image is transferred to the transfer material, part of the toner often remains on the surface of the electrophotographic photosensitive member. Hereafter, such a toner remaining after the transferring step is also referred to as "untransferred toner". In a general electrophotographic process, such an untransferred toner is removed from the surface of an electrophotographic photosensitive member with a cleaning unit. Specifically, an untransferred toner is removed by, for example, a method of bringing a cleaning blade into contact with an electrophotographic photosensitive member and scraping off an untransferred toner from the electrophotographic photosensitive member, a method of using a fur brush, or a combination of these methods. At present, in view of ease of cleaning and cleaning performance, the method of using a cleaning blade is widely employed. As for such a cleaning blade, a cleaning blade composed of an elastic body such as urethane rubber is widely used.

As for an electrophotographic photosensitive member, in view of low cost, high productivity, and the like, an organic electrophotographic photosensitive member is commonly used at present that includes a support and a photosensitive layer (organic photosensitive layer) composed of an organic material serving as a photoconductive substance (a charge generation substance or a charge transport substance), the photosensitive layer being formed on the support. As for such a photosensitive layer (organic photosensitive layer), a multilayer photosensitive layer is mainly used in which a charge generation layer containing a charge generation substance and a charge transport layer containing a charge transport substance are stacked. Such a multilayer photosensitive layer is advantageous in that high sensitivity can be achieved, various material designs are allowed, and the like.

The uppermost layer of an electrophotographic photosensitive member (hereafter, referred to as "surface layer") has been actively improved for the purpose of enhancing the durability of an electrophotographic photosensitive member or suppressing degradation of image quality. For example, to enhance the strength of such a surface layer, techniques have been studied such as improvement of resins (binder resins) for the surface layer and addition of filler or the like to the surface layer.

However, it is known that an increase in the strength of a surface layer makes it difficult to sufficiently remove charge products (corona products) on the surface of an electrophotographic photosensitive member, which tends to result in image deletion.

To deal with this problem, Patent Citation 1 discloses a technique of removing such charge products from the surface of an electrophotographic photosensitive member in which a toner containing relatively large inorganic fine particles as an external additive is used and the surface of the electrophotographic photosensitive member is polished with the inorganic fine particles.

Patent Citation 2 discloses a technique of processing the surface of an electrophotographic photosensitive member with a stamper having well-shaped depressed portions. Patent Citations 3 to 6 disclose techniques of roughening the surface of an electrophotographic photosensitive member.

As disclosed in Patent Citation 1, a technique of removing charge products adhering to the surface of an electrophotographic photosensitive member is known in which a toner containing relatively large inorganic fine particles as an external additive is used. Specifically, the size of such inorganic fine particles needs to be within the range of 0.1 μm to 1.5 μm.

However, when an identical format is printed many times, for example, vertical lines are continuously printed in a large quantity of sheets, a toner is fed only to specific portions of the surface of an electrophotographic photosensitive member in a concentrated manner. Thus, relatively large inorganic fine particles contained in the toner as an external additive are also fed only to the specific portions of the surface of the electrophotographic photosensitive member in a concentrated manner. As a result, the inorganic fine particles excessively polish the specific portions, which can result in many fine scratches on the surface of the electrophotographic photosensitive member. When such fine scratches are generated in a large number in a portion of the surface of an electrophotographic photosensitive member and the scratches have a width of more than about 50 μm, output images have streak-shaped image defects such as white streaks.

Patent Citation 1

Japanese Patent Laid-Open No. 2-257145

Patent Citation 2

Japanese Patent Laid-Open No. 2001-066814

Patent Citation 3

Japanese Patent Laid-Open No. 2007-233354

Patent Citation 4

Japanese Patent Laid-Open No. 2007-233356

Patent Citation 5

Japanese Patent Laid-Open No. 2007-233357

Patent Citation 6

Japanese Patent Laid-Open No. 2007-233359

DISCLOSURE OF INVENTION

Technical Problem

The present invention provides an electrophotographic apparatus and a process cartridge with which generation of the streak-shaped image defects is suppressed.

Solution to Problem

The present invention provides an electrophotographic apparatus including:

an electrophotographic photosensitive member including a support and a photosensitive layer formed on the support;

a developing unit configured to develop an electrostatic latent image formed on a surface of the electrophotographic photosensitive member with a toner containing, as an external additive, inorganic fine particles having a number-average particle size (P[μm]) of 0.1 μm or more and 1.5 μm or less; and a cleaning unit configured to remove untransferred toner remaining on the surface of the electrophotographic photosensitive member with a cleaning blade, wherein, depressed portions which are independent from one another, are formed in the surface of the electrophotographic photosensitive member at a density of 10 or more of the depressed portions per unit area of 1 $cm^2$, and each of the depressed portions satisfies the following conditions;

Conditions each of the depressed portions satisfies the following relationships where a depth of each of the depressed portions is defined as Rdv[μm], a minor-axis diameter of each of the depressed portions is defined as Lpc[μm], a major-axis diameter of each of the depressed portions is defined as Rpc[μm], and an angle formed between a direction of a major-axis of each of the depressed portions and a direction of movement of the surface of the electrophotographic photosensitive member is defined as θ[°]:

$$5[°] \leq \theta[°] \leq 85[°],$$

$$0.3 \times P[\mu m] \leq Rdv[\mu m] \leq 0.5 \times P[\mu m],$$

$$1.1 \times P[\mu m] \leq Lpc[\mu m] \leq 1.5 \times P[\mu m], \text{ and}$$

$$50/\text{Sin}\ \theta[\mu m] \leq Rpc[\mu m] \leq 1500[\mu m].$$

The present invention also provides a process cartridge detachably mountable to a main body of an electrophotographic apparatus, the process cartridge including:

an electrophotographic photosensitive member including a support and a photosensitive layer formed on the support;

a developing unit configured to develop an electrostatic latent image formed on a surface of the electrophotographic photosensitive member with a toner containing, as an external additive, inorganic fine particles having a number-average particle size (P[μm]) of 0.1 μm or more and 1.5 μm or less; and a cleaning unit configured to remove untransferred toner remaining on the surface of the electrophotographic photosensitive member with a cleaning blade, wherein, depressed portions which are independent from one another, are formed in the surface of the electrophotographic photosensitive member at a density of 10 or more of the depressed portions per unit area of 1 $cm^2$, and each of the depressed portions satisfies the following conditions;

Conditions each of the depressed portions satisfies the following relationships where a depth of each of the depressed portions is defined as Rdv[μm], a minor-axis diameter of each of the depressed portions is defined as Lpc[μm], a major-axis diameter of each of the depressed portions is defined as Rpc[μm], and an angle formed between a direction of a major-axis of each of the depressed portions and a direction of movement of the surface of the electrophotographic photosensitive member is defined as θ[°]:

$$5[°] \leq \theta[°] \leq 85[°],$$

$$0.3 \times P[\mu m] \leq Rdv[\mu m] \leq 0.5 \times P[\mu m],$$

$$1.1 \times P[\mu m] \leq Lpc[\mu m] \leq 1.5 \times P[\mu m], \text{ and}$$

$$50/\text{Sin}\ \theta[\mu m] \leq Rpc[\mu m] \leq 1500[\mu m].$$

The present invention can provide an electrophotographic apparatus and a process cartridge with which generation of the streak-shaped image defects is suppressed.

DESCRIPTION OF EMBODIMENTS

Figure 1:
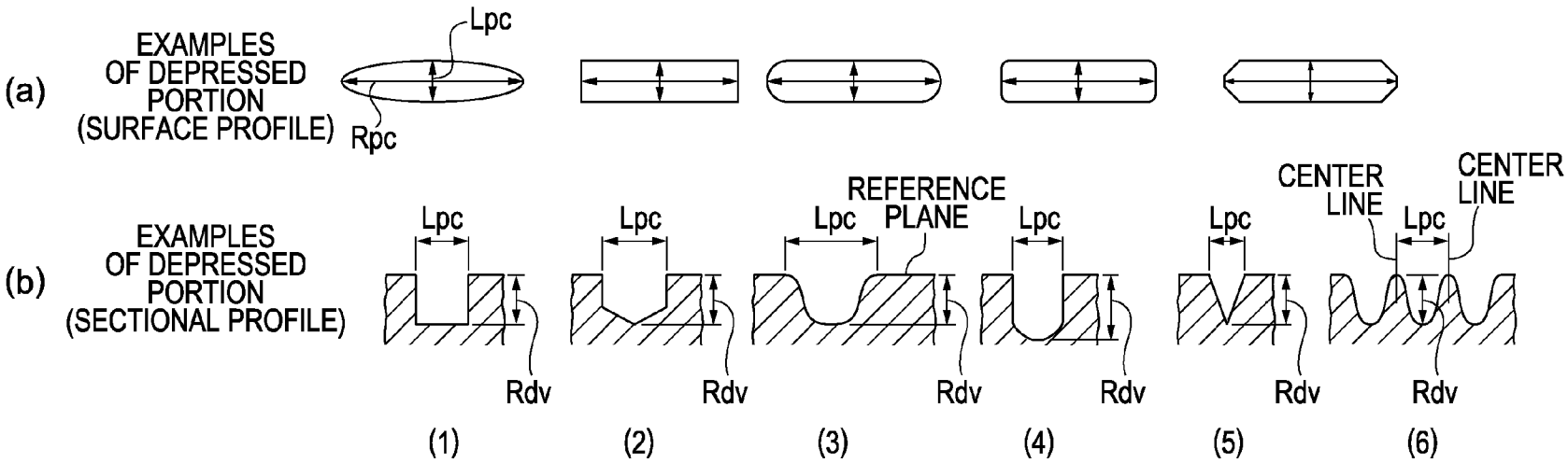
FIG. 1 illustrates examples of the surface profiles (profiles viewed from above) and the sectional profiles of a depressed portion formed in the surface of an electrophotographic photosensitive member according to the present invention.

First, a toner and inorganic fine particles used for the present invention will be described.

A method for producing such a toner is not particularly restricted. For example, a binder resin, a magnetic substance, a charge control agent, and other necessary additives such as a release agent are dry blended with a mixer such as a Henschel mixer or a ball mill. The resultant mixture is melted and kneaded with a thermal kneader such as a kneader, a roll mill, or an extruder to thereby make resins compatible with each other. The resultant melt-kneaded product is cooled and solidified. The thus-solidified product is roughly ground to provide a roughly ground product. The roughly ground product is finely ground with a collision-type air pulverizer such as a jet mill, a micron jet, or an IDS-type mill; or a mechanical-type pulverizer such as a Kryptron, a turbo mill, or an Inomizer. The resultant finely ground product is classified with an airflow classifier or the like to provide a classified product having a desired particle size distribution. This classified product is mixed with inorganic fine particles serving as an external additive to provide a toner used for the present invention.

The inorganic fine particles contained as an external additive in a toner used for the present invention have a number-average particle size (P[μm]) of 0.1 μm or more and 1.5 μm or less. Such inorganic fine particles can be produced by, for example, sintering, mechanically grinding the resultant sinter, and subjecting the resultant ground sinter to air classification to provide inorganic fine particles having a desired particle size distribution. A material for such inorganic fine particles is, for example, strontium titanate, barium titanate, or calcium titanate. In the following description, inorganic fine particles contained as an external additive in a toner and having a number-average particle size (P[μm]) of 0.1 μm or more and 1.5 μm or less are sometimes simply referred to as "inorganic fine particles".

Example of Production of Inorganic Fine Particles

After 600 g of strontium carbonate and 320 g of titanium oxide were wet blended with a ball mill for 8 hours, the resultant mixture was filtrated, dried, molded at a pressure of 0.49 N/mm$^2$, and calcined at 1100° C. for 8 hours. The resultant product was mechanically ground to provide strontium titanate fine particles (fine powder) having a number-average particle size P of 1.0 μm.

In this example, the number-average particle size of the inorganic fine particles was determined in the following manner.

Randomly 100 inorganic fine particles in a micrograph taken with a transmission electron microscope (magnification: 30000) were selected and the maximum lengths of the selected particles were determined. The arithmetic mean of the resultant maximum lengths was calculated to provide the number-average particle size of the inorganic fine particles.

Hereinafter, the surface profile of an electrophotographic photosensitive member used in the present invention will be described.

An electrophotographic photosensitive member according to the present invention includes a support and a photosensitive layer formed on the support. Depressed portions which are independent from one another, are formed on the surface of the electrophotographic photosensitive member at a density of 10 or more of the depressed portions per unit area of 1 cm$^2$.

Each of these depressed portions satisfies the following relationships where the depth of each of the depressed portions is defined as Rdv[μm], the minor-axis diameter of each of the depressed portions is defined as Lpc[μm], the major-axis diameter of each of the depressed portions is defined as Rpc[μm], and the angle formed between the direction of a major-axis of each of the depressed portions and the direction of movement of the surface of the electrophotographic photosensitive member is defined as θ[°]:

$$5[°] \leq \theta[°] \leq 85[°],$$

$$0.3 \times P[\mu m] \leq Rdv[\mu m] \leq 0.5 \times P[\mu m],$$

$$1.1 \times P[\mu m] \leq Lpc[\mu m] \leq 1.5 \times P[\mu m], \text{ and}$$

$$50/\sin\theta[\mu m] \leq Rpc[\mu m] \leq 1500[\mu m].$$

FIG. 1 illustrates examples of the surface profiles (profiles viewed from above) and the sectional profiles of a depressed portion formed on the surface of an electrophotographic photosensitive member according to the present invention. As shown in FIG. 1(*a*), a depressed portion may have various surface profiles such as elliptic profiles, polygonal profiles (rectangular profiles, hexagonal profiles, and the like), and profiles constituted by polygons and curves constituting corners of or part of or the entirety of sides of the polygons. As shown in FIG. 1(*b*), a depressed portion may also have various sectional profiles such as polygonal profiles (quadrangular profiles and the like), wavelike profiles constituted by continuous curves, and profiles constituted by polygons and curves in edges of or in part of or in the entirety of sides of the polygons.

All the depressed portions formed on the surface of an electrophotographic photosensitive member may be the same in terms of the profiles, the minor-axis diameter, the major-axis diameter, the depth, and the angle. Alternatively, the depressed portions formed on the surface of an electrophotographic photosensitive member may be different in terms of the profiles, the minor-axis diameter, the major-axis diameter, the depth, the angle, or the like.

Figure 2:
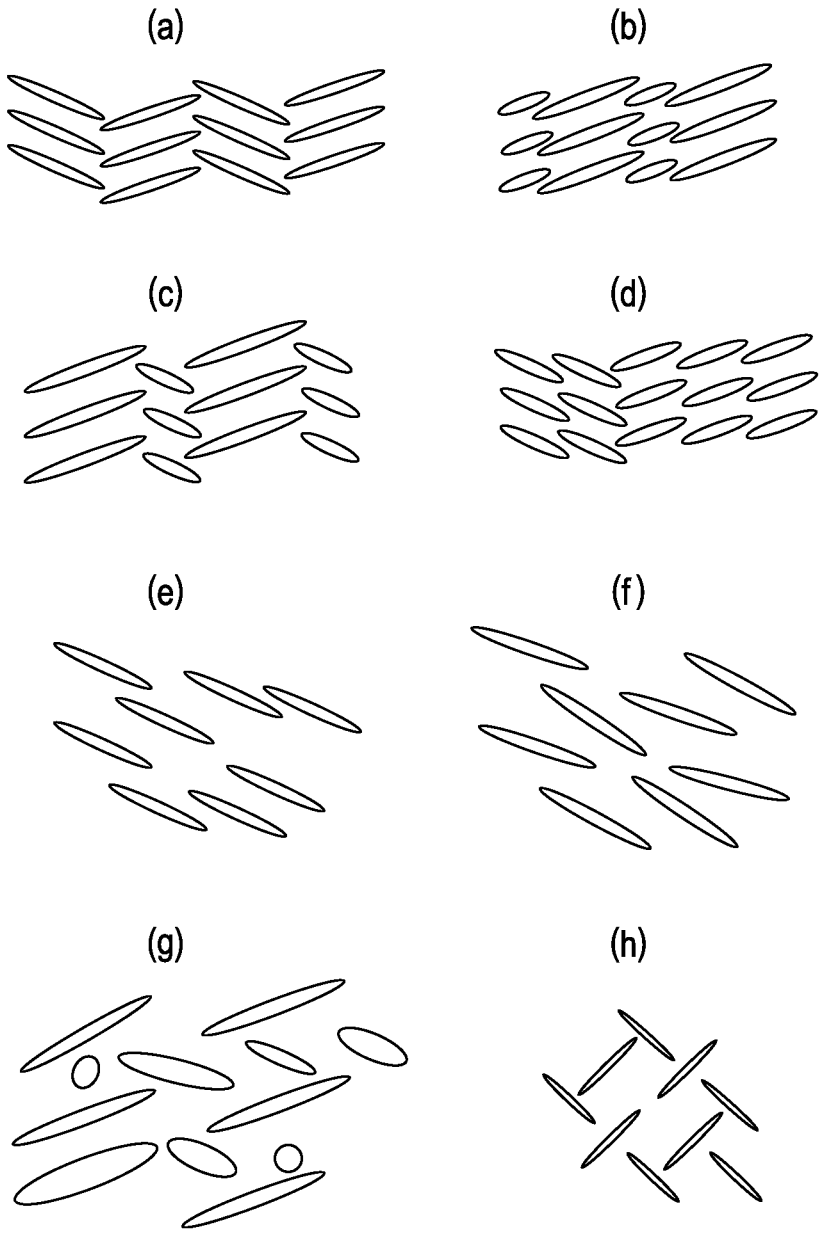
FIG. 2 illustrates examples of an arrangement pattern of depressed portions.

FIG. 2 (*a*) to (*h*) illustrate examples of an arrangement pattern of such depressed portions.

Figure 3:
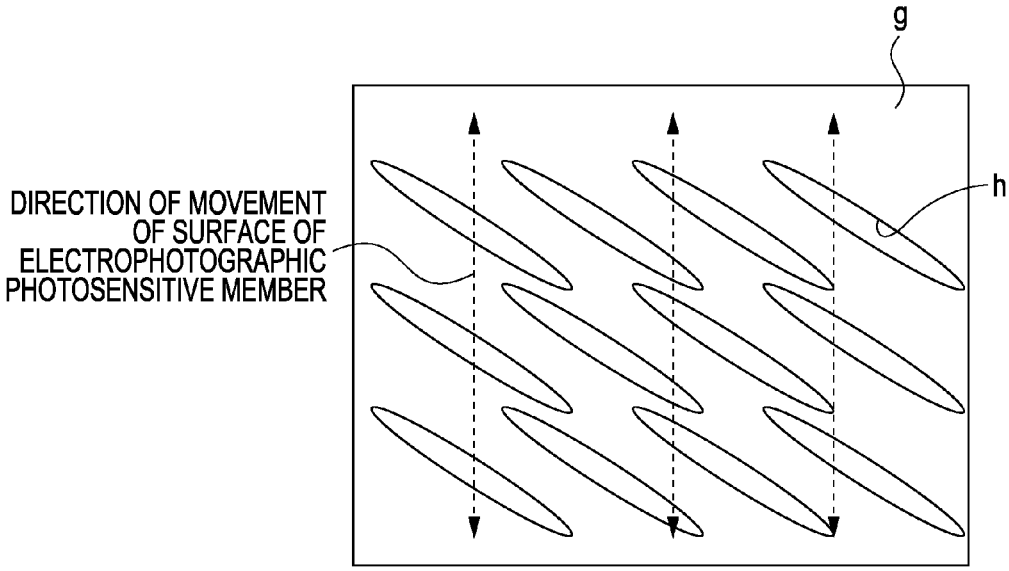
FIG. 3 is an enlarged view of an example of an arrangement pattern of depressed portions according to the present invention.

FIG. 3 is an enlarged view of an example of an arrangement pattern of depressed portions according to the present invention. In FIG. 3, g denotes an area where a depressed portion is not formed, and h denotes a depressed portion.

Hereinafter, the minor-axis diameter Lpc, the major-axis diameter Rpc, and the depth Rdv of each of depressed portions according to the present invention will be described.

As shown in FIG. 1(*a*), the minor-axis diameter Lpc of a depressed portion according to the present invention is defined as the length of the shortest straight line among straight lines obtained by projecting the opening portion of the depressed portion in the horizontal direction. Stated another way, when the depressed portion is sandwiched between two straight lines such that the distance between the two straight lines is minimized, the distance between the two straight lines is the minor-axis diameter Lpc of the depressed portion. For example, when a depressed portion has an elliptical profile, the minor-axis diameter Lpc of the depressed portion corresponds to the short diameter of the elliptical profile. When a depressed portion has a rectangular profile, the minor-axis diameter Lpc of the depressed portion corresponds to a short side of the rectangular profile.

The major-axis diameter Rpc of a depressed portion according to the present invention is defined as the length of a straight line obtained by projecting the opening portion of the depressed portion in the longitudinal direction of the minor-axis diameter Lpc. The major-axis diameter Rpc is orthogonal to the minor-axis diameter Lpc. For example, when a depressed portion has an elliptical profile, the major-axis diameter Rpc of the depressed portion corresponds to the long diameter of the elliptical profile. When a depressed portion has a rectangular profile, the major-axis diameter Rpc of the depressed portion corresponds to a long side of the rectangular profile. As is obvious from this example where a depressed portion has a rectangular profile, the major-axis diameter Rpc in the present invention is not necessarily the length of the longest straight line (a diagonal line for the rectangular profile) among straight lines obtained by projecting the opening portion of the depressed portion in the horizontal direction.

The minor-axis diameter Lpc is specifically determined in the following manner. For example, referring to (3) in FIG.

1(*b*) where the boundary between the depressed portion and the flat portion is not clear, the opening portion of the depressed portion is defined with reference to the flat surface before being roughened in consideration of the sectional profile of the depressed portion and the minor-axis diameter Lpc is determined in the above-described manner.

Referring to (6) in FIG. 1(*b*) where the flat surface before being roughened is not clear, center lines are drawn in the sectional profile of neighboring depressed portions and the major-axis diameter Rpc is determined as the distance between the center lines.

Referring to FIG. 1(*b*), the depth Rdv of a depressed portion is defined as the distance between the deepest portion of the depressed portion and the plane of the opening (opening portion) of the depressed portion.

The angle θ of a depressed portion is an angle formed between the direction of a major-axis of the depressed portion and the direction of movement of the surface of an electrophotographic photosensitive member. The direction of a major-axis of a depressed portion is a line including the major-axis diameter Rpc.

An electrophotographic photosensitive member according to the present invention includes depressed portions which are independent from one another, are formed on the surface of the electrophotographic photosensitive member at a density of 10 or more of the depressed portions per unit area of 1 $cm^2$, and preferably at a density of 20 or more of the depressed portions per unit area of 1 $cm^2$. And each of the depressed portions satisfies the above-described conditions.

As described above, in the present invention, the minor-axis diameter (Lpc[μm]) of each of the depressed portions and the number-average particle size (P[μm]) of inorganic fine particles contained as an external additive in a toner satisfy the following relationship.

$$1.1\times P[\mu m]\leq Lpc[\mu m]\leq 1.5\times P[\mu m]$$

When the minor-axis diameter Lpc of each of the depressed portions is less than 1.1 times the number-average particle size P of inorganic fine particles, the inorganic fine particles are less likely to be caught in the depressed portions. As a result, a cleaning blade does not sufficiently direct the inorganic fine particles in the direction of the rotation shaft of an electrophotographic photosensitive member, the direction being orthogonal to the direction of movement of the surface of the electrophotographic photosensitive member. Thus, the inorganic fine particles remain concentrated in a particular portion of the surface of the electrophotographic photosensitive member. This causes many fine scratches on the surface of the electrophotographic photosensitive member, which tends to result in output images having streak-shaped image defects such as white streaks. Stated another way, when the minor-axis diameter Lpc of each of depressed portions is 1.1 or more times the number-average particle size P of inorganic fine particles, the inorganic fine particles being caught in the depressed portions in the surface of the electrophotographic photosensitive member are caused to flow in the direction of the rotation shaft of the electrophotographic photosensitive member upon contact with a cleaning blade. This reduces the concentration of the inorganic fine particles and hence the occurrence of the above-described problems is reduced.

When the minor-axis diameter Lpc of each of depressed portions is more than 1.5 times the number-average particle size P of inorganic fine particles, a plurality of the inorganic fine particles may enter each depressed portion, which destabilizes the state of the inorganic fine particles being caught in the depressed portions. As a result, also in this case, a cleaning blade does not sufficiently direct the inorganic fine particles in the direction of the rotation shaft of the electrophotographic photosensitive member.

As described above, in the present invention, the depth (Rdv[μm]) of each of depressed portions and the number-average particle size (P[μm]) of inorganic fine particles contained as an external additive in a toner satisfy the following relationship.

$$0.3\times P[\mu m]\leq Rdv[\mu m]\leq 0.5\times P[\mu m]$$

When the depth Rdv of each of depressed portions is less than 0.3 times the number-average particle size P of inorganic fine particles, the inorganic fine particles are less likely to be caught in the depressed portions. As a result, also in this case, a cleaning blade does not sufficiently direct the inorganic fine particles in the direction of the rotation shaft of the electrophotographic photosensitive member.

When the depth Rdv of each of depressed portions is more than 0.5 times the number-average particle size P of inorganic fine particles, the inorganic fine particles entering the depressed portions are not sufficiently caught by a cleaning blade. As a result, the cleaning blade also does not sufficiently direct the inorganic fine particles in the direction of the rotation shaft of an electrophotographic photosensitive member.

As described above, in the present invention, the major-axis diameter (Rpc[μm]) of each of depressed portions and the number-average particle size (P [μm]) of inorganic fine particles contained as an external additive in a toner satisfy the following relationship.

$$50/\sin\theta[\mu m]\leq Rpc[\mu m]\leq 1500[\mu m]$$

To cause inorganic fine particles to flow with a cleaning blade, the depressed portions need to have an elongated shape. When the major-axis diameter Rpc is less than 50/Sin θ, a cleaning blade does not sufficiently direct the inorganic fine particles in the direction of the rotation shaft of the electrophotographic photosensitive member.

After the inorganic fine particles are caused to flow for a distance in the direction of the rotation shaft of an electrophotographic photosensitive member, the inorganic fine particles need to be scraped off from the surface of the electrophotographic photosensitive member with a cleaning blade. An end (in the direction of the major-axis) of a depressed portion (an end of a depressed portion in the direction of the major-axis diameter) functions as the starting point where the inorganic fine particles are scraped off. If the situation where the inorganic fine particles are concentrated in a portion of a cleaning blade occurs, disadvantages such as insufficient cleaning due to overflowing of a toner at the portion may be caused. For this reason, ends (in the direction of the major-axis diameter) of a depressed portion serving as the starting points where the inorganic fine particles are scraped off are preferably scattered over a wide area on the surface of an electrophotographic photosensitive member. Thus, in the present invention, the major-axis diameter Rpc of each of depressed portions is made 1500 μm or less, and the depressed portions are provided at a density of 10 or more of the depressed portions per unit area of 1 $cm^2$.

Inorganic fine particles may be insufficiently directed in the direction of the rotation shaft of an electrophotographic photosensitive member with a cleaning blade and depressed portions in the surface of the electrophotographic photosensitive member when the number of the depressed portions is too small. For this reason, in the present invention, depressed portions are provided in the surface of an electrophotographic photosensitive member at a density of 10 or more of the depressed portions per unit area of 1 $cm^2$.

Figure 4:
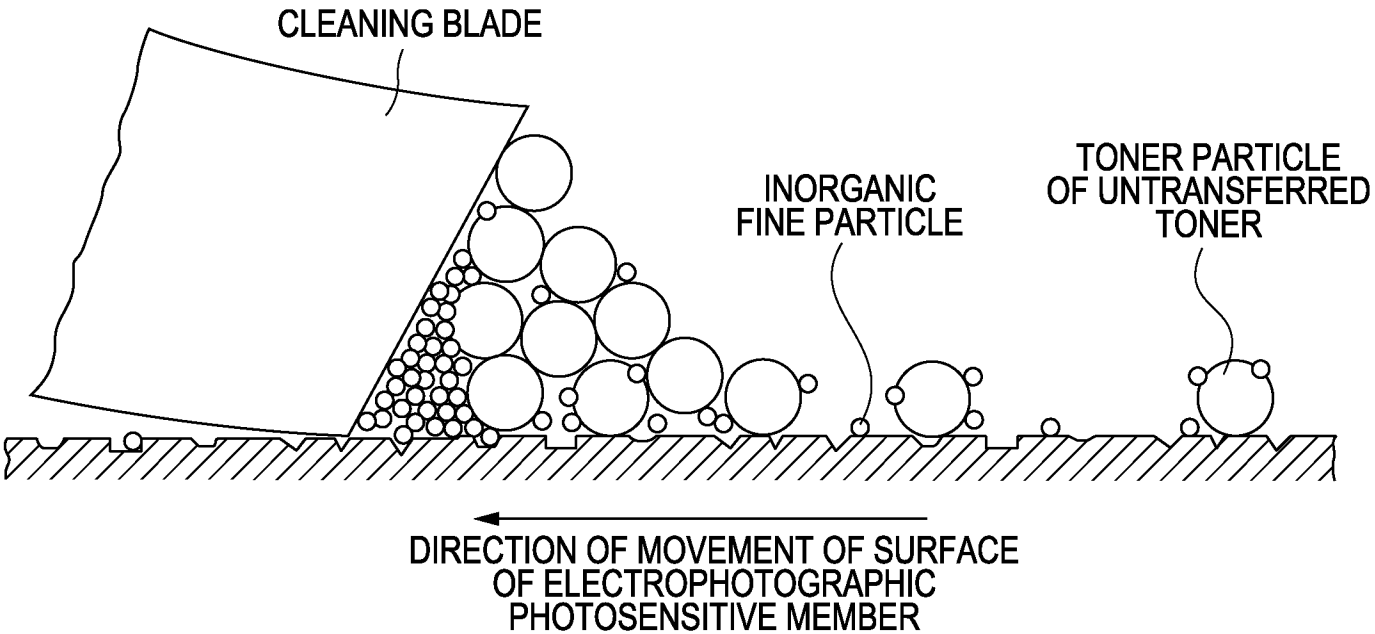
FIG. 4 illustrates a position (nip) where a cleaning blade and the surface of an electrophotographic photosensitive member are in contact with each other, and an area around the position.

Referring to FIG. 4, inorganic fine particles are present in the upstream portion, in the direction of movement of the surface of an electrophotographic photosensitive member, from the position (nip) where the cleaning blade and the surface of the electrophotographic photosensitive member are in contact with each other.

Figure 5:
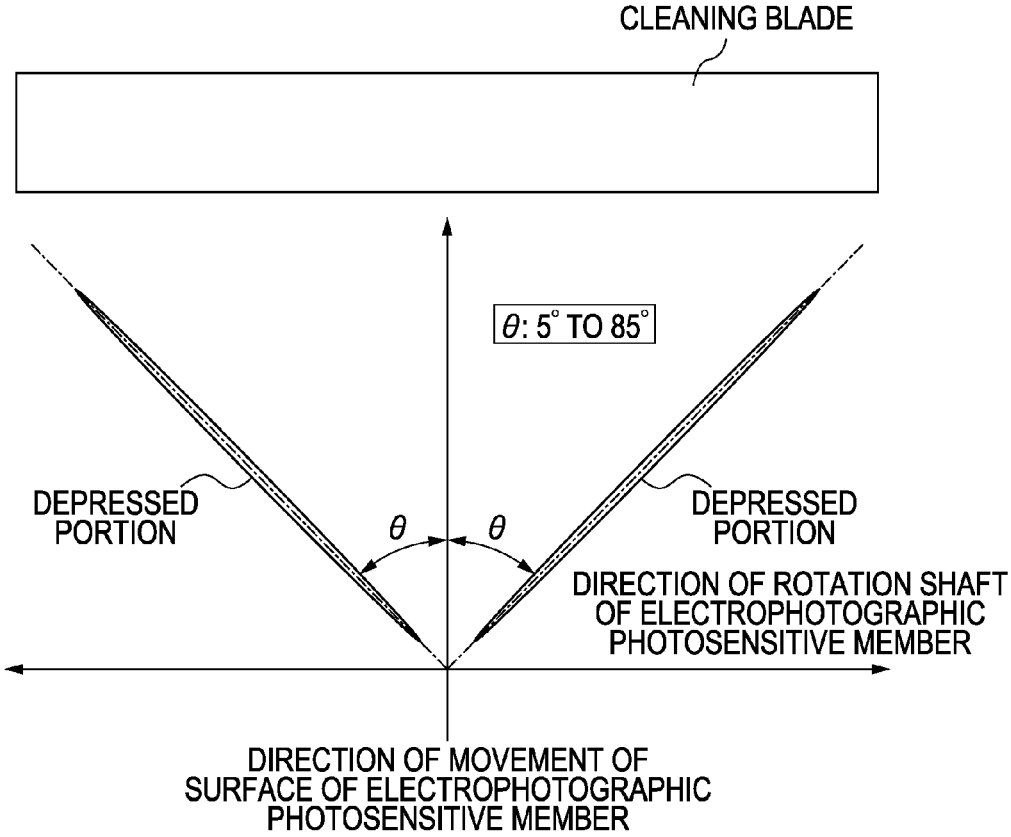
FIG. 5 is an explanatory view for an angle formed between the direction of a major-axis of a depressed portion in the surface of an electrophotographic photosensitive member and the direction of movement of the surface of the electrophotographic photosensitive member.

Referring to FIG. 5, where the direction of the rotation shaft of an electrophotographic photosensitive member is defined as 0° and the direction of movement of the surface of the electrophotographic photosensitive member is defined as 90°, the angle θ of each of depressed portions (the angle of the direction of the major-axis of each of the depressed portions) of 0° or 90° does not allow inorganic fine particles to be directed (caused to flow) in the direction of the rotation shaft of the electrophotographic photosensitive member. In contrast, when the angle θ of each of depressed portions has a certain value, specifically 5° or more and 85° or less, a force is generated that directs inorganic fine particles in the direction of the rotation shaft of the electrophotographic photosensitive member. Note that two θs in FIG. 5 are positive values and they are not defined such that one θ is a positive value and the other θ is a negative value.

Figure 6:
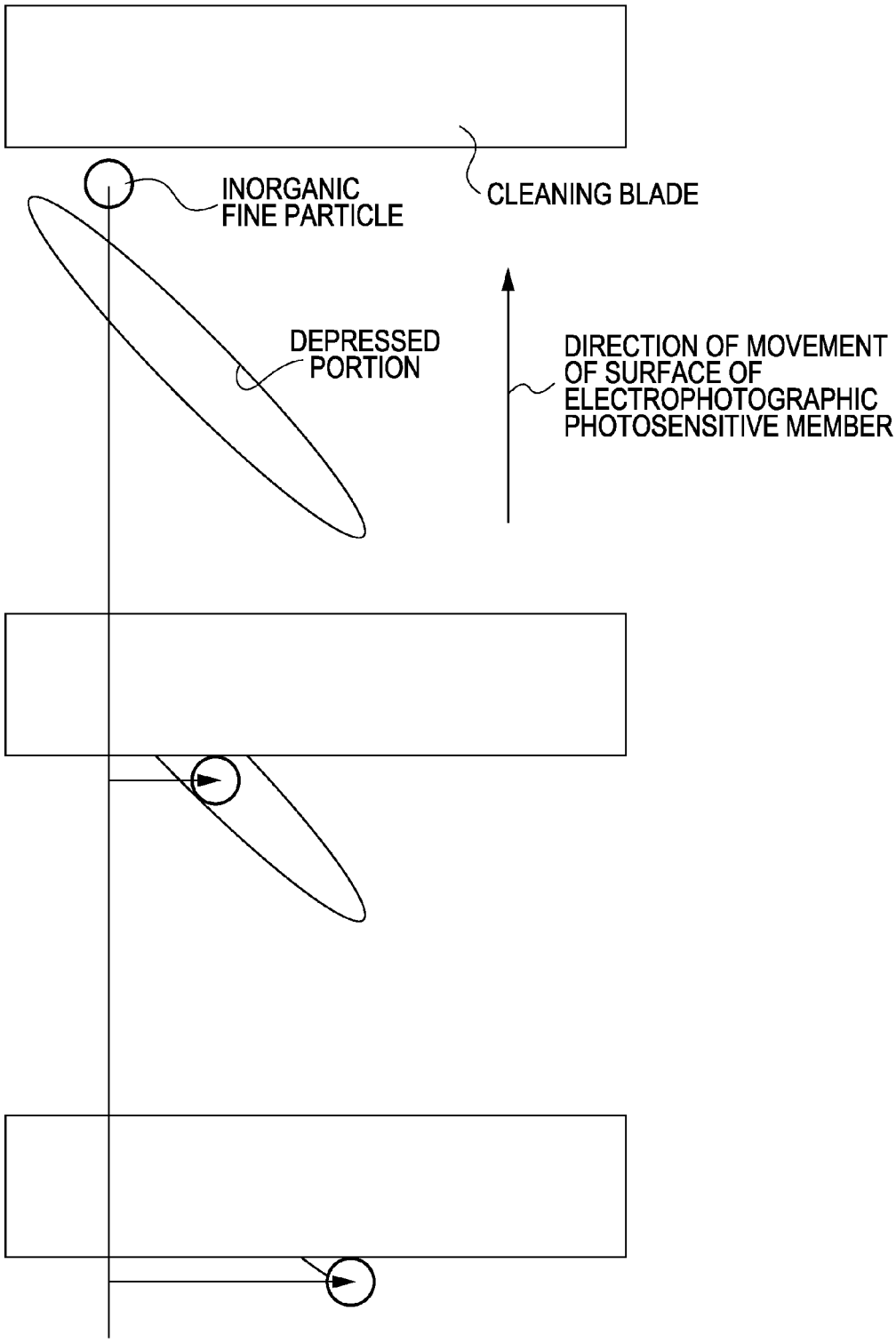
FIG. 6 illustrates the situation where a force that directs an inorganic fine particle in the direction of the rotation shaft of an electrophotographic photosensitive member is exerted.

FIG. 6 shows the situation where a force is exerted that directs inorganic fine particles in the direction of the rotation shaft of an electrophotographic photosensitive member. As is clear from FIG. 6, when the force that directs inorganic fine particles in the direction of the rotation shaft of an electrophotographic photosensitive member is not exerted, the inorganic fine particles tend to remain concentrated in a portion on the surface of the electrophotographic photosensitive member and the inorganic fine particles excessively polish the portion. This causes many fine scratches particularly in the portion. When such scratches have a width of more than 50 μm, output images have streak-shaped image defects such as white streaks in black solid images.

Accordingly, in the present invention, the angle θ[°] formed between the direction of the major-axis of each of the depressed portions and the direction of movement of the surface of an electrophotographic photosensitive member is 5° or more and 85° or less, preferably 10° or more and 80° or less, more preferably 20° or more and 70° or less, and still more preferably 30° or more and 60° or less.

Note that Japanese Patent Laid-Open Nos. 2001-066814, 2007-233354, 2007-233356, 2007-233357, and 2007-233359 do not specifically describe the number-average particle size of inorganic fine particles, the depth of each of the depressed portions, the minor-axis diameter of each of the depressed portions, the major-axis diameter of each of depressed portions, or the angle formed between the direction of the major-axis of each of the depressed portions and the direction of movement of the surface of an electrophotographic photosensitive member.

Hereinafter, a method for forming depressed portions in the surface of an electrophotographic photosensitive member according to the present invention will be described.

Such a method for forming depressed portions is not particularly restricted as long as the above-described requirements for each of the depressed portions can be satisfied. For example, such depressed portions may be formed by radiation of an excimer laser.

An excimer laser is laser light emitted in the following steps.

First, a gas mixture of a rare gas such as Ar, Kr, or Xe and a halogen gas such as F or Cl is energized with discharge, electron beams, X-rays, or the like to be excited to thereby bond the atoms. Second, the bonded atoms are separated due to transition to the ground state and, at this time, excimer laser light is emitted.

Examples of a gas used for emitting an excimer laser include ArF, KrF, XeCl, and XeF. Of these examples, KrF and ArF are preferred.

Figure 7A:
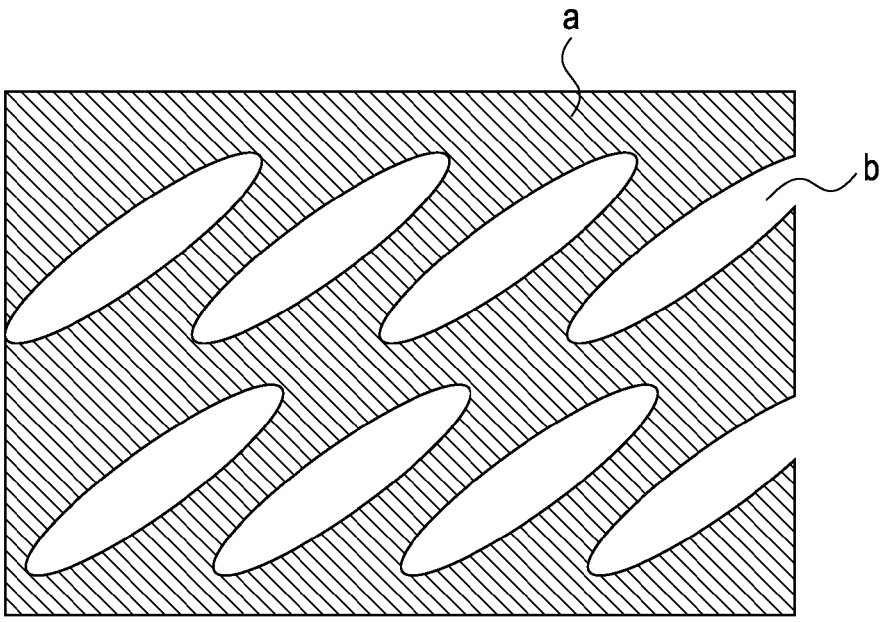
FIG. 7A illustrates an example of a mask.
Figure 7B:
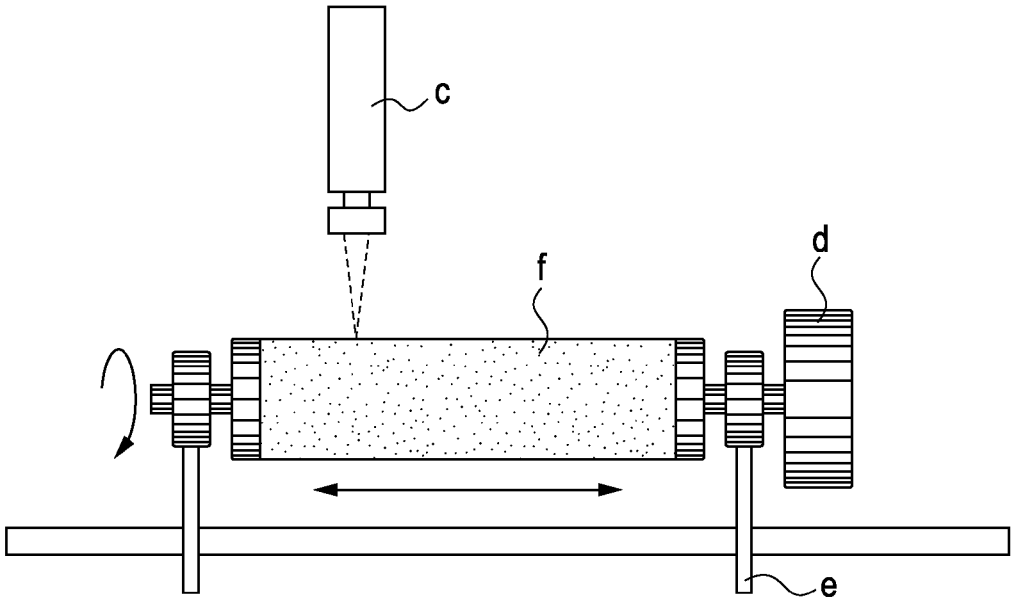
FIG. 7B illustrates an example of a laser processing apparatus.

In a method for forming depressed portions, for example, a mask shown in FIG. 7A may be used in which an area a for shielding laser light and areas b for transmitting the laser light therethrough are appropriately arranged. Only the laser light transmitted through the mask is collected with a lens and used to irradiate an electrophotographic photosensitive member (work). This allows formation of depressed portions having desired profiles and a desired arrangement. This method permits instant and simultaneous formation of many depressed portions in a certain area irrespective of the profiles and the area of the depressed portions and hence this method requires only a short period of time. Radiation of a laser through a mask allows processing of an area of several square millimeters to several square centimeters per radiation. Referring to FIG. 7B, such processing with a laser is conducted while a work is rotated with a motor d for rotating the work. While a work is rotated, a position irradiated with a laser is shifted in the direction of the shaft of an electrophotographic photosensitive member (work) with an apparatus e for moving a work. In this way, depressed portions can be efficiently formed over the entire surface area of the electrophotographic photosensitive member. The depth of each of the depressed portions can be controlled within a desired range by changing the period for radiation of laser light, the number of radiation of laser light, or the like. Use of this method permits a roughening process with a high degree of freedom in which the size, profiles, and arrangement of depressed portions are highly controllable, and high precision is achieved. In FIG. 7B, c denotes an apparatus for outputting excimer laser light, d denotes a motor for rotating a work, e denotes an apparatus for moving a work, and f denotes an electrophotographic photosensitive member (work).

An identical mask pattern may be used in the above-described processing. This enhances the uniformity of roughened surface over the entire surface of an electrophotographic photosensitive member.

Other than the above-described method, there is another method for forming depressed portions in the surface of an electrophotographic photosensitive member according to the present invention: a mold having a desired pattern is pressed onto the surface of an electrophotographic photosensitive member (work) to thereby transfer the pattern to the work.

Figure 8A:
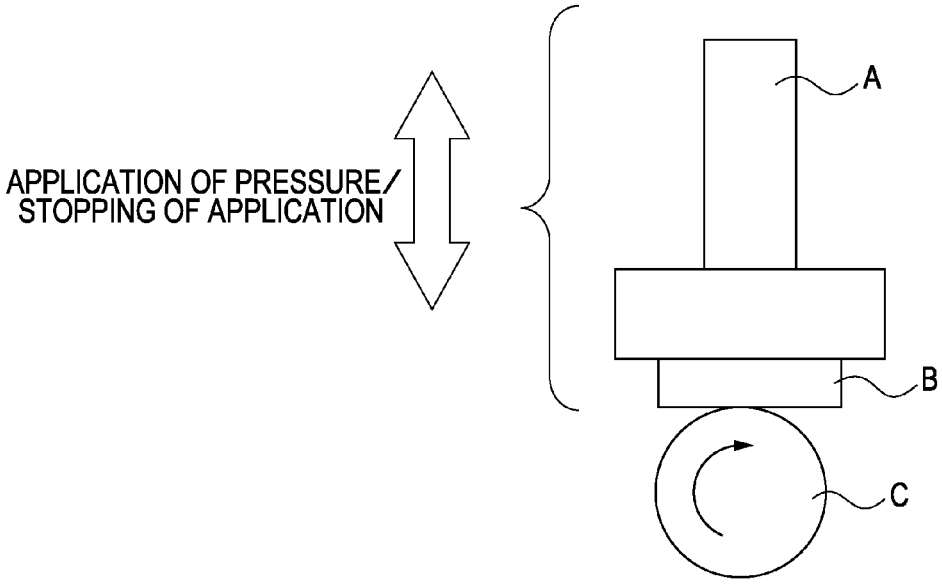
FIG. 8A illustrates an example of a processing apparatus for transferring a pattern by pressing with a mold.

FIG. 8A illustrates an example of the schematic configuration of a processing apparatus for transferring a pattern by pressing with a mold.

A unit A for applying pressure is configured to repeat application of pressure and stopping of the application of pressure. The unit A for applying pressure is equipped with a desired mold B. This mold B is then pressed onto an electrophotographic photosensitive member (work) C at a desired pressure with the unit A to thereby transfer the pattern of the mold B to the work C. After that, the application of pressure is stopped and the electrophotographic photosensitive member C is rotated. Subsequently, the application of pressure and the transferring of the pattern are conducted again. A repeat of this step of transferring the pattern allows formation of desired depressed portions over the entire surface of the electrophotographic photosensitive member C.

Figure 8B:
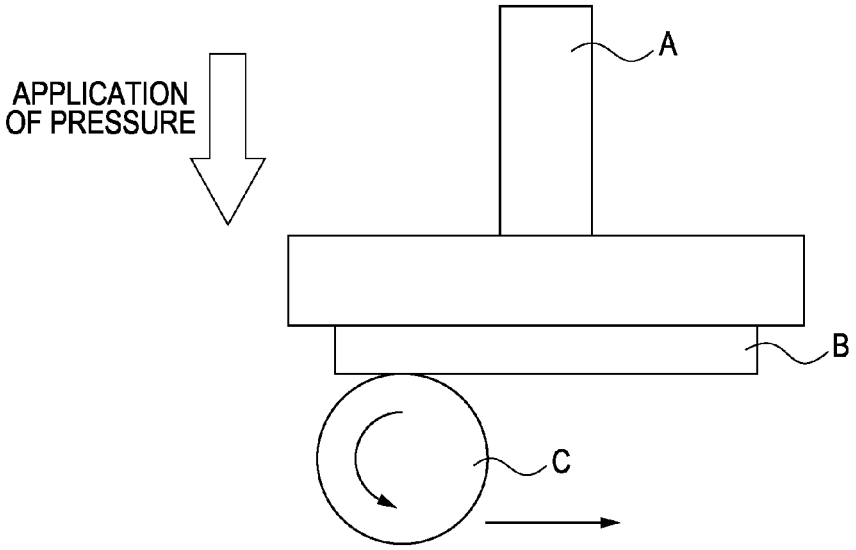
FIG. 8B illustrates another example of a processing apparatus for transferring a pattern by pressing with a mold.

Alternatively, for example, another processing apparatus having a configuration shown in FIG. 8B may be used. A unit A for applying pressure is equipped with a desired mold B having a length almost equal to the overall circumference of an electrophotographic photosensitive member (work) C. This mold B is then pressed onto the electrophotographic photosensitive member C at a desired pressure with the unit A while the electrophotographic photosensitive member C is rotated and rolled to thereby form desired depressed portions over the entire surface of the electrophotographic photosensitive member C.

Alternatively, another processing apparatus may be used. For example, a sheet-shaped mold is interposed between a roll-shaped unit for applying pressure and an electrophotographic photosensitive member, and the surface of the electrophotographic photosensitive member is processed while the sheet-shaped mold is sent through between the roll-shaped unit and the electrophotographic photosensitive member.

To efficiently conduct the transferring of a pattern, a mold and/or an electrophotographic photosensitive member may be heated.

The material(s), the size, and the pattern of a mold may be appropriately selected. As for the material(s), a mold may be a metal film having a finely patterned surface, a resin film having a finely patterned surface, a silicon wafer or the like having a surface patterned with resist, a resin film in which fine particles are dispersed, a resin film that has a certain fine surface profile and is coated with metal, or the like.

Figure 9:
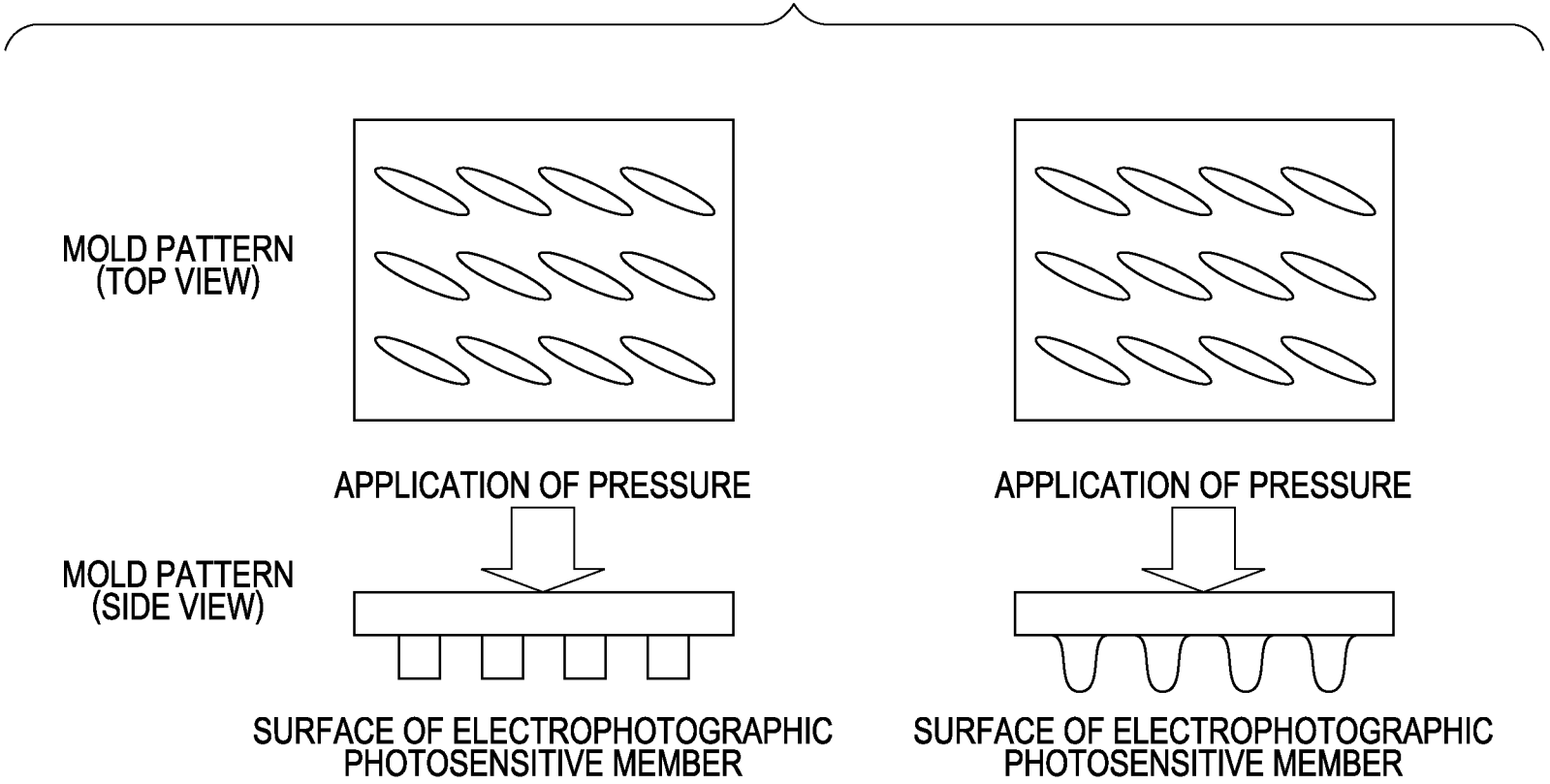
FIG. 9 illustrates examples of a mold.

FIG. 9 illustrates examples of the pattern of a mold.

To uniformly press an electrophotographic photosensitive member, an elastic member may be interposed between a mold and a unit for applying pressure.

Hereinafter, the configuration of an electrophotographic photosensitive member used in the present invention will be described.

As described above, an electrophotographic photosensitive member used in the present invention includes a support and a photosensitive layer formed on the support. An electrophotographic photosensitive member used in the present invention is preferably a cylindrical electrophotographic photosensitive member including a cylindrical support. Alternatively, an electrophotographic photosensitive member may have the shape of a belt, a sheet, or the like.

The photosensitive layer may be a single-layer photosensitive layer containing both a charge transport substance and a charge generation substance, or a multilayer (separated-function) photosensitive layer functionally divided into a charge generation layer containing a charge generation substance and a charge transport layer containing a charge transport substance. In viewpoints of electrophotographic properties, an electrophotographic photosensitive member used in the present invention preferably includes a multilayer photosensitive layer. Such a multilayer photosensitive layer may be a normal order-type photosensitive layer produced by layering a charge generation layer on a support and layering a charge transport layer on the charge generation layer, or a reverse order-type photosensitive layer produced by layering a charge transport layer on a support and layering a charge generation layer on the charge transport layer. When a multilayer photosensitive layer is used, a charge generation layer may have a multilayer configuration and/or a charge transport layer may have a multilayer configuration. To enhance the durability of an electrophotographic photosensitive member or the like, a protection layer may be formed on the photosensitive layer of the electrophotographic photosensitive member.

The support may be any support having electrical conductivity (conductive support). Examples thereof include metal (alloy) supports such as iron, copper, gold, silver, aluminum, zinc, titanium, lead, nickel, tin, antimony, indium, chromium, aluminum alloy, and stainless steel supports. Plastic supports and the above-described metal (alloy) supports including layers formed by vapor-depositing a metal (alloy) such as aluminum, an aluminum alloy, or an indium oxide-tin oxide alloy in a vacuum may also be used. Supports made by impregnating plastics or paper with conductive particles such as carbon black, tin oxide particles, titanium oxide particles, or silver particles together with binder resins, and plastic supports containing conductive binder resins may also be used.

To suppress interference patterns caused by scattering of laser light or the like, the surface of a support may be machined, roughened, anodized, or the like.

To suppress interference patterns caused by scattering of laser light or the like and to cover scratches of a support, a conductive layer may be formed between a support and an intermediate layer described below or between a support and a photosensitive layer (charge generation layer or charge transport layer).

Such a conductive layer may be formed with a coating solution for forming a conductive layer obtained by dispersing and/or dissolving carbon black, a conductive pigment, or a pigment for adjusting resistance in a solvent with a binder resin. Such a coating solution for forming a conductive layer may contain a compound that is hardened by polymerization caused by heating or application of radiation. A conductive layer in which a conductive pigment or a pigment for adjusting resistance is dispersed tends to have a roughened surface.

Such a conductive layer preferably has a thickness of 0.2 μm or more and 40 μm or less, more preferably 1 μm or more and 35 μm or less, and still more preferably 5 μm or more and 30 μm or less.

Examples of the binder resin used for such a conductive layer include polymers and copolymers of vinyl compounds such as styrene, vinyl acetate, vinyl chloride, acrylates, methacrylates, vinylidene fluoride, and trifluoroethylene; polyvinyl alcohol, polyvinyl acetal, polycarbonate, polyester, polysulfone, polyphenylene oxide, polyurethane, cellulosic resins, phenolic resins, melamine resins, silicon resins, and epoxy resins.

Examples of the conductive pigment and the pigment for adjusting resistance include particles of metal (alloy) such as aluminum, zinc, copper, chromium, nickel, silver, or stainless steel; plastic particles whose surfaces are covered with such a metal (alloy) by vapor deposition; and particles of metal oxide such as zinc oxide, titanium oxide, tin oxide, antimony oxide, indium oxide, bismuth oxide, indium oxide doped with tin, or tin oxide doped with antimony or tantalum. These examples may be used alone or in combination of two or more thereof. When these examples are used in combination of two or more thereof, they may be simply mixed together, may be turned into a solid solution, or may be fused together.

An intermediate layer having a barrier function or an adhesive function may be provided between a support and a photosensitive layer (charge generation layer and charge transport layer) or between a conductive layer and a photosensitive layer (charge generation layer and charge transport layer). Such an intermediate layer is formed to improve the adhesion of a photosensitive layer, coatability, and property of injecting charge from a support, to protect a photosensitive layer from electric breakdown, or the like.

Examples of a material that can be used to form such an intermediate layer include polyvinyl alcohol, poly-N-vinylimidazole, polyethylene oxide, ethyl cellulose, ethylene-acrylic acid copolymers, casein, polyamide, N-methoxymethylated 6-nylon, nylon copolymers, glue, and gelatin. The intermediate layer can be formed by preparing a coating solution for forming the intermediate layer obtained by dissolving such a material in a solvent, coating the coating solution, and drying the coated solution.

The intermediate layer preferably has a thickness of 0.05 μm or more and 7 μm or less, more preferably, 0.1 μm or more and 2 μm or less.

Examples of a charge generation substance used for a photosensitive layer include selenium-tellurium-based dyes, pyrylium-based dyes, thiapyrylium-based dyes, and phthalocyanine pigments containing various central metals and having various crystal systems (α, β, γ, ϵ, X type, or the like), anthanthorone pigments, dibenzpyrene quinone pigments, pyranthrone pigments, azo pigments such as monoazo, disazo, and trisazo pigments, indigo pigments, quinacridon pigments, asymmetrical quinocyanine pigments, quinocyanine pigments, and amorphous silicon. These charge generation substances may be used alone or in combination of two or more thereof.

Examples of a charge transport substance used for a photosensitive layer include pyrene compounds, N-alkyl carbazole compounds, hydrazone compounds, N,N-dialkylaniline compounds, diphenylamine compounds, triphenylamine compounds, triphenylmethane compounds, pyrazoline compounds, styryl compounds, and stilbene compounds.

When a photosensitive layer includes a charge generation layer and a charge transport layer that have different functions, the charge generation layer can be formed in the following manner. A charge generation substance together with a binder resin in an amount that is 0.3 to 4 times the amount of the charge generation substance (on a mass basis) and a solvent are subjected to a dispersing treatment with a homogenizer, an ultrasonic disperser, a ball mill, a vibration ball mill, a sand mill, an attritor, a roll mill, or the like. The resultant solution for forming a charge generation layer is coated and dried to form the charge generation layer. Alternatively, the charge generation layer may be a film formed by vapor depositing a charge generation substance.

The charge transport layer can be formed by preparing a coating solution for forming the charge transport layer obtained by dissolving a charge transport substance and a binder resin in a solvent, coating the coating solution, and drying the coated solution. Alternatively, when a charge transport substance with which a film can be formed without addition of a binder resin is used, a film serving as a charge transport layer may be formed of the charge transport substance alone without addition of a binder resin.

Examples of the binder resin used for the charge generation layer or the charge transport layer include polymers and copolymers of vinyl compounds such as styrene, vinyl acetate, vinyl chloride, acrylates, methacrylates, vinylidene fluoride, and trifluoroethylene; polyvinyl alcohol, polyvinyl acetal, polycarbonate, polyester, polysulfone, polyphenylene oxide, polyurethane, cellulosic resins, phenolic resins, melamine resins, silicon resins, and epoxy resins.

The charge generation layer preferably has a thickness of 5 μm or less, more preferably, 0.1 μm or more and 2 μm or less.

The charge transport layer preferably has a thickness of 5 μm or more and 50 μm or less, more preferably, 10 μm or more and 35 μm or less.

In the configuration where a photosensitive layer is a multilayer photosensitive layer and the surface layer of an electrophotographic photosensitive member is a charge transport layer, it is important to design materials for forming the charge transport layer for the purpose of enhancing the durability of the electrophotographic photosensitive member, the durability being one of characteristics required for electrophotographic photosensitive members. For example, a binder resin having a high strength may be used, the ratio of a charge transport substance exhibiting plasticity to a binder resin may be controlled, or a polymeric charge transport substance may be used. To further enhance the durability of an electrophotographic photosensitive member, it is advantageous that the charge transport layer serving as the surface layer is formed with a hardening resin.

In the present invention, a charge transport layer that is provided immediately above a charge generation layer can be formed with a hardening resin. It is also possible to form a charge transport layer with a non-hardening resin (thermoplastic resin) and to form, on the charge transport layer, a layer serving as a second charge transport layer or a protective layer with a hardening resin. A layer formed with a hardening resin is required to have both sufficiently high film strength and the capability of transporting charge. Such a layer is generally formed with a charge transport substance and a polymerizable or crosslinkable monomer or a polymerizable or crosslinkable oligomer.

In this case, the charge transport substance may be a known positive-hole transport compound or a known electron transport compound. Examples of the polymerizable or crosslinkable monomer and the polymerizable or crosslinkable oligomer include a chain polymerization material containing an acryloyloxy group or a styrene group, and a step-growth polymerization material containing a hydroxy group, an alkoxysilyl group, an isocyanate group, or the like. In view of the resultant electrophotographic characteristics, versatility, material design, stability in production, or the like, the combination of a positive-hole transport compound and a chain polymerization material is preferred, and particularly preferred is a system in which a compound including both a positive-hole transport group and an acryloyloxy group in a molecule is hardened.

Such hardening can be conducted with heat, light, radiation, or the like.

When a layer formed with a hardening resin is a charge transport layer formed immediately above a charge generation layer, as in the above-described case, the charge transport layer preferably has a thickness of 5 μm or more and 50 μm or less, more preferably, 10 μm or more and 35 μm or less. When a layer formed with a hardening resin is a second charge transport layer or a protective layer, it preferably has a thickness of 0.1 μm or more and 20 μm or less, more preferably, 1 μm or more and 10 μm or less.

In the present invention, an electrophotographic photosensitive member produced by the above-described method is subjected to the above-described laser processing, the above-described processing of pressing a mold with a pattern and transferring the pattern, or the like to thereby form desired depressed portions.

Layers of an electrophotographic photosensitive member according to the present invention may contain various additives. Examples of such additives include antidegradants such as antioxidants and ultraviolet absorbing agents, and lubricants such as resin particles containing fluorine atoms.

Hereinafter, a method for observing depressed portions formed in the surface of an electrophotographic photosensitive member according to the present invention will be described.

In the present invention, such depressed portions in the surface can be measured with a commercially available laser microscope. For example, the following equipment and accompanying analysis programs may be used.

Ultra-depth scanning microscopes VK-8550, VK-8700, and VK-9500 manufactured by KEYENCE CORPORA- TION Surface profile measurement system Surface Explorer SX-520DR manufactured by Ryoka Systems Inc. Laser confocal scanning microscope OLS3000 manufactured by Olympus Corporation Real color confocal microscope OPTELICS C130 manufactured by Lasertec Corporation Use of such a laser microscope permits measurements of depressed portions in terms of the number of the depressed portions in a field of view, the minor-axis diameter of each of the depressed portion, the major-axis diameter of each of the depressed portion, and the depth of each of the depressed portion at a certain magnification. Alternatively, another microscope such as an optical microscope, an electron microscope, an atomic force microscope, or a scanning probe microscope may also be used for observing and measuring the depressed portions.

Hereinafter, the configurations of an electrophotographic apparatus and a process cartridge according to the present invention will be described.

Figure 10:
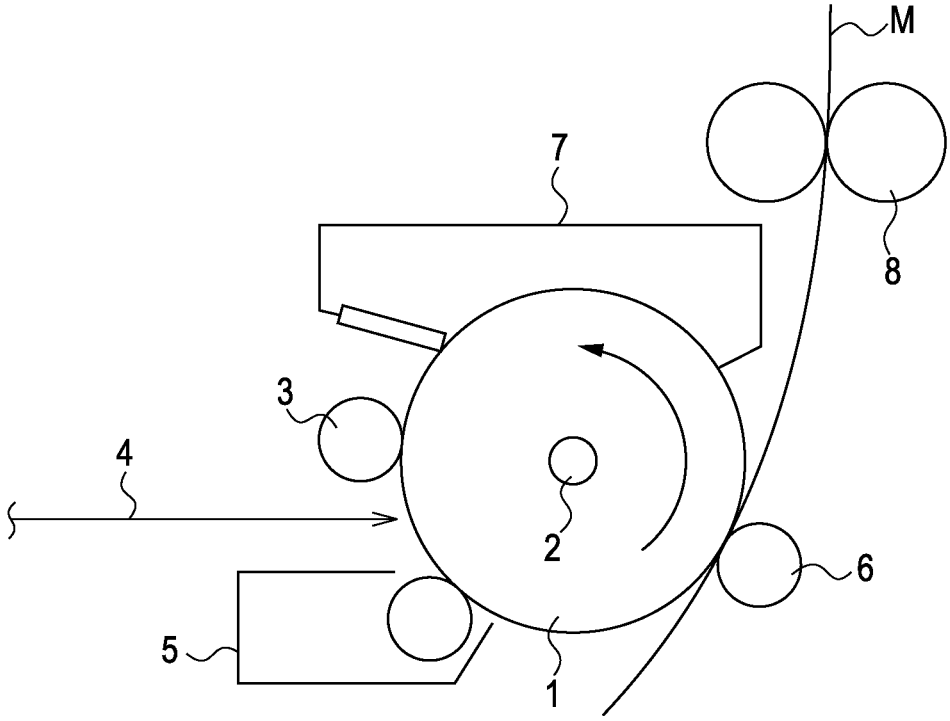
FIG. 10 illustrates an example of the schematic configuration of an electrophotographic apparatus equipped with a process cartridge.

FIG. 10 is an example of the schematic configuration of an electrophotographic apparatus equipped with a process cartridge.

A cylindrical electrophotographic photosensitive member 1 is driven and rotated about a shaft 2 at a particular peripheral velocity in the direction indicated by the arrow. The surface (peripheral surface) of the rotating electrophotographic photosensitive member 1 is uniformly charged to a particular positive or negative electric potential with a charging unit (primary charging unit such as a charging roller) 3. Next, the surface of the electrophotographic photosensitive member 1 is irradiated with exposure light (image exposure light) 4 output from an exposure unit (not shown) employing a slit exposure technique, a laser beam scanning exposure technique, or the like. As a result, electrostatic latent images corresponding to a target image are sequentially formed on the surface of the electrophotographic photosensitive member 1. Note that the charging unit 3 is not restricted to a contact-type charging unit using the charging roller shown in FIG. 10 or the like. Alternatively, a corona charging unit including a corona charging device may be used and a charging unit of another type may also be used.

The electrostatic latent images formed on the surface of the electrophotographic photosensitive member 1 are developed with a toner contained in a developing agent of a developing unit 5 to form toner images. Then the toner images formed on the surface of the electrophotographic photosensitive member 1 are transferred to a transfer material (such as paper) M by a transfer bias from a transfer unit (such as a transfer roller) 6. Note that the transfer material M may be fed from a transfer material feeder (not shown) to a nip (contact portion) between the electrophotographic photosensitive member 1 and the transfer unit 6 in synchronization with the rotation of the electrophotographic photosensitive member 1. An intermediate transferring scheme may also be used in which the toner images are transferred to an intermediate transfer member (such as an intermediate transfer belt) instead of a transfer material and the transferred images are subsequently transferred to a transfer material (such as paper).

The transfer material M onto which the toner images have been transferred is separated from the surface of the electrophotographic photosensitive member 1, introduced into a fixing unit 8 to have the images fixed thereon, and discharged outside the apparatus as an image-formed material (print or copy).

The surface of the electrophotographic photosensitive member 1 after the transferring of toner images is cleaned by a cleaning unit 7 with a cleaning blade to remove untransferred toner (toner that remains on the surface of the electrophotographic photosensitive member 1). Then the surface of the electrophotographic photosensitive member 1 is subjected to charge elimination with pre-exposure light (not shown) from a pre-exposure unit (not shown) and repeatedly used for image formation. The untransferred toner collected with the cleaning unit 7 is sent as a waste toner to a waste-toner container 9. As shown in FIG. 10, when the charging unit 3 is a contact-type charging unit that uses a charging roller or the like, pre-exposure is not always necessary.

The electrophotographic photosensitive member 1, the developing unit 5, and the cleaning unit 7 may be housed in a casing to be integrated into one process cartridge, and this process cartridge may be designed to be detachably mountable to the main body of an electrophotographic apparatus such as a copy machine or a laser beam printer.

Hereinafter, the present invention will be described with reference to non-limiting examples. Note that "parts" referred to in Examples means "parts by mass".

Example 1

An aluminum cylinder having a diameter of 30 mm and a length of 370 mm was used as a support (cylindrical support).

A coating solution for forming a conductive layer was prepared by subjecting a solution composed of the following components to a dispersing treatment with a ball mill for 20 hours.

Barium sulfate particles having tin oxide coated layers (product name: Passtran PC1, manufactured by MITSUI MINING & SMELTING CO., LTD): 60 parts Titanium oxide (product name: TITANIX JR, manufactured by Tayca Corporation): 15 parts Resol-type phenolic resin (product name: PHENOLITE J-325, manufactured by DIC Corporation, solid content: 70%): 43 parts Silicone oil (product name: SH28PA, manufactured by Toray Silicone Co., Ltd.): 0.015 parts Silicone resin (product name: TOSPEARL 120, manufactured by Toshiba Silicone Co., Ltd.): 3.6 parts 2-Methoxy-1-propanol: 50 parts Methanol: 50 parts The resultant coating solution for forming a conductive layer was applied to the support by dip coating. The applied solution was hardened by heating in an oven at 140° C. for an hour to form a conductive layer having a thickness of 16 μm.

Next, a coating solution for forming an intermediate layer was prepared by dissolving the following components in a solvent mixture containing 400 parts of methanol and 200 parts of n-butanol.

Copolymeric nylon resin (product name: Amilan CM8000, manufactured by Toray Industries, Inc.): 10 parts Methoxymethylated 6-nylon resin (product name: TORESIN EF-30T, manufactured by Teikoku Chemical Industries Co., Ltd.): 30 parts The resultant coating solution for forming an intermediate layer was applied to the conductive layer by dip coating. The applied solution was dried by heating in an oven at 100° C. for 30 minutes to form an intermediate layer having a thickness of 0.45 μm.

Next, a coating solution for forming a charge generation layer was prepared by subjecting the following components to a dispersing treatment for 4 hours with a sand mill apparatus using glass beads having a diameter of 1 mm, and subsequently mixing the resultant solution with 700 parts of ethyl acetate.

Hydroxygallium phthalocyanine crystals (charge generation substance) of a type having strong peaks at $2\theta \pm 0.2°$ ($\theta$ represents a Bragg angle in X-ray diffraction with $CuK_\alpha$) of 7.5° and 28.3°: 20 parts Calixarene compound represented by the following structural formula (1): 0.2 parts Structural formula (1)

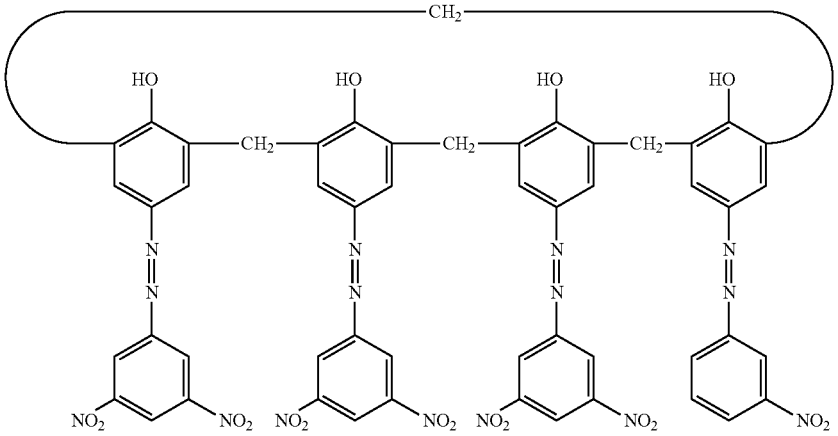

Polyvinyl butyral (product name: S-LEC BX-1, manufactured by SEKISUI CHEMICAL CO., LTD.): 10 parts Cyclohexanone: 600 parts The resultant coating solution for forming a charge generation layer was applied to the intermediate layer by dip coating. The applied solution was dried by heating in an oven at 80° C. for 15 minutes to form a charge generation layer having a thickness of 0.17 μm.

Next, a coating solution for forming a charge transport layer was prepared by dissolving the following components in a solvent mixture containing 600 parts of monochlorobenzene and 200 parts of methylal.

Positive-hole transport compound (charge transport substance) represented by the following structural formula (2): 70 parts Structural formula (2)

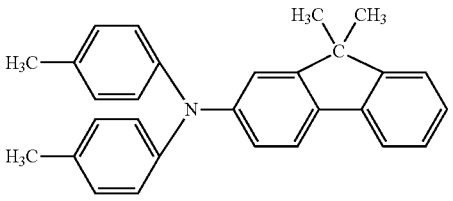

Polycarbonate resin (product name: Iupilon Z400, manufactured by Mitsubishi Engineering-Plastics Corporation): 100 parts The resultant coating solution for forming a charge transport layer was applied to the charge generation layer by dip coating. The applied solution was dried by heating in an oven at 90° C. for 40 minutes to form a charge transport layer having a thickness of 18 μm.

Next, a coating solution for forming a second charge transport layer was prepared in the following manner. First, 0.5 parts of a resin containing fluorine atoms (product name: GF-300, manufactured by TOAGOSEI CO., LTD.) was dissolved in a solvent mixture containing 20 parts of 1,1,2,2,3,3,4-heptafluorocyclopentane (product name: ZEORORA H, manufactured by ZEON CORPORATION) and 20 parts of 1-propanol. The resultant solution was mixed with 10 parts of tetrafluoroethylene resin particles (product name: Lubron L-2, manufactured by DAIKIN INDUSTRIES, LTD.) serving as a lubricant. The resin containing fluorine atoms functioned as a dispersing agent for the tetrafluoroethylene resin particles.

The resultant solution was subjected to a dispersing treatment four times with a high-pressure dispersing apparatus (product name: Microfluidizer M-110EH, manufactured by Microfluidics in the USA) at a pressure of 58.8 MPa.

The resultant solution was filtrated through a polyflon filter (product name: PF-040, manufactured by Advantec Toyo Kaisha, Ltd.) to provide a dispersion solution of the lubricant.

After that, this dispersion solution of the lubricant was mixed with 90 parts of a positive-hole transport compound represented by the following structural formula (3), 70 parts of 1,1,2,2,3,3,4-heptafluorocyclopentane, and 70 parts of 1-propanol.

Structural formula (3)

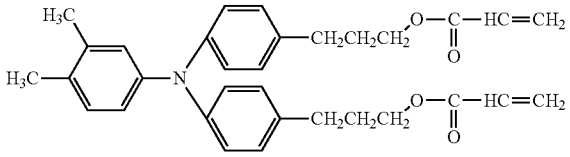

The resultant solution was filtrated through a polyflon filter (product name: PF-020, manufactured by Advantec Toyo Kaisha, Ltd.) to provide a coating solution for forming a second charge transport layer.

The resultant coating solution for forming a second charge transport layer was applied to the charge transport layer. The applied solution was then dried in the air atmosphere in an oven at 50° C. for 10 minutes. After that, the resultant layer was irradiated with electron beams for 1.4 seconds in nitrogen atmosphere under irradiation conditions of an acceleration voltage of 70 kV and a beam current of 7.0 mA while the support was rotated at 200 rpm. The resultant layer was then hardened in the nitrogen atmosphere by increasing the temperature from 25° C. to 110° C. over 30 seconds. In the irradiation, the absorbed dose of the electron beams was 18 kGy. The atmosphere in the radiation of electron beams and the hardening reaction by heating had an oxygen concentration of 15 ppm or less. After that, the resultant layer was allowed to cool naturally to 25° C. in the air atmosphere and then heated in the air atmosphere in an oven at 120° C. for 10 minutes. Thus, a second charge transport layer (protective layer) having a thickness of 4 μm was formed.

Thus, an electrophotographic photosensitive member on the surface of which depressed portions were to be formed was provided.

Formation of Depressed Portions by Transferring Pattern of Mold by Pressing

The surface of the thus-obtained electrophotographic photosensitive member was subjected to the processing of formation of depressed portions with an apparatus having the configuration shown in FIG. 8B and a mold having a pattern shown in FIG. 9. The mold included individual depressed portions having the shape of an elliptic cylinder having a major-axis diameter of 785 μm, a minor-axis diameter of 1.3 μm, and a height of 0.8 μm; and having an angle of the direction of the major-axis of 45°. The pattern of the mold was transferred to the electrophotographic photosensitive member by pressing the mold to the electrophotographic photosensitive member at a pressure of 2.94 N/mm$^2$ while the temperatures of the mold and the electrophotographic photosensitive member were controlled such that the surface of the electrophotographic photosensitive member had a temperature of 120° C. upon the processing of formation of the depressed portions and the electrophotographic photosensitive member was rotated in the peripheral direction.

Observation of Depressed Portions

The thus-obtained surface profile of the electrophotographic photosensitive member was microscopically observed with a laser microscope (VK-9500 manufactured by KEYENCE CORPORATION). This observation revealed that depressed portions having the shape of an elliptic cylinder having a major-axis diameter Rpc of 785 μm, a minor-axis diameter Lpc of 1.3 μm, a depth Rdv of 0.4 μm, and an angle θ of 45° were formed at a density of 15 depressed portions per unit area of 1 cm$^2$. Note that the angle θ in Examples and Comparative Examples denotes the angle θ formed between the direction of the major-axis of each of the depressed portions and the direction of movement of the surface of an electrophotographic photosensitive member.

Evaluation

The electrophotographic photosensitive member on the surface of which the depressed portions were thus formed was incorporated into an electrophotographic apparatus (copying machine iR4570P manufactured by CANON KABUSHIKI KAISHA). The durability of the electrophotographic photosensitive member was evaluated with the following endurance test.

The initial potential of the electrophotographic photosensitive member was adjusted by setting potential conditions such that the electrophotographic photosensitive member had a dark potential (Vd) of −700 V and a light potential (Vl) of −200 V in an environment of 30° C./85% RH.

A cleaning blade composed of polyurethane rubber was provided such that the contact angle of the cleaning blade with respect to the surface of the electrophotographic photosensitive member was 26° and the contact pressure of the cleaning blade to the surface of the electrophotographic photosensitive member was 29.4 N/m.

As for inorganic fine particles that were contained in a toner and had a number-average particle size P of 0.1 μm or more and 1.5 μm or less, the strontium titanate fine powder particles were used that were produced in the above-described example of production of inorganic fine particles and had a number-average particle size P of 1.0 μm. These inorganic fine particles were mixed with a toner such that 102 parts by mass of the toner contained 2 parts by mass of the inorganic fine particles.

The endurance test was conducted such that images were output every other sheet among 10,000 A4 sheets. Test chart data printed in the endurance test included an image in which five vertical lines having a length of 150 mm and a width of 50 μm were arranged so as to be equally spaced apart from each other.

After the endurance test was complete, a solid black image was output and the presence or absence of white streaks on this image was determined. The surface of the electrophotographic photosensitive member was observed with an ultra-depth scanning microscope VK-8550 manufactured by KEYENCE CORPORATION and the widths, in the direction of the rotation shaft of the electrophotographic photosensitive member, of scratches on the surface was determined.

The number of white streaks on the output image and the maximum width of the scratches on the surface of the electrophotographic photosensitive member are shown in Table 1 below.

Examples 2 to 34

Electrophotographic photosensitive members were produced and evaluated as in Example 1 except that the number-average particle size P of inorganic fine particles, the number of depressed portions per unit area of 1 cm$^2$ in the surface of an electrophotographic photosensitive member, and the shape, angle θ, depth Rdv, minor-axis diameter Lpc, and major-axis diameter Rpc of each of the depressed portions were set as shown in Table 1 below. The evaluation results are also shown in Table 1.

Comparative Example 1

An electrophotographic photosensitive member was produced and evaluated as in Example 1 except that depressed portions were not formed in the surface of the electrophotographic photosensitive member. The evaluation results are shown in Table 2 below.

Comparative Examples 2 to 26

Electrophotographic photosensitive members were produced and evaluated as in Example 1 except that the number-average particle size P of inorganic fine particles, the number of depressed portions per unit area of 1 cm$^2$ in the surface of an electrophotographic photosensitive member, and the shape, angle θ, depth Rdv, minor-axis diameter Lpc, and major-axis diameter Rpc of each of the depressed portions were set as shown in Table 2 below. The evaluation results are also shown in Table 2.

TABLE 1

| | Number-average particle size P of inorganic fine particles | Shape | Angle θ | Depth Rdv | Minor-axis diameter Lpc | Major-axis diameter Rpc | Number | Number of white streaks | Maximum width of scratches |
|---|---|---|---|---|---|---|---|---|---|
| Example 1 | 1.0 | elliptic cylinder | 45 | 0.4 | 1.3 | 785 | 15 | 0 | 15 |
| Example 2 | 0.1 | elliptic cylinder | 45 | 0.04 | 0.13 | 785 | 15 | 0 | 20 |
| Example 3 | 1.5 | elliptic cylinder | 45 | 0.6 | 1.95 | 785 | 15 | 0 | 30 |
| Example 4 | 1.0 | elliptic cylinder | 5 | 0.4 | 1.3 | 574 | 15 | 0 | 40 |
| Example 5 | 1.0 | elliptic cylinder | 5 | 0.4 | 1.3 | 1500 | 15 | 0 | 40 |
| Example 6 | 1.0 | elliptic cylinder | 85 | 0.4 | 1.3 | 51 | 15 | 0 | 45 |
| Example 7 | 1.0 | elliptic cylinder | 85 | 0.4 | 1.3 | 1500 | 15 | 0 | 40 |
| Example 8 | 1.0 | elliptic cylinder | 45 | 0.3 | 1.3 | 785 | 15 | 0 | 20 |
| Example 9 | 1.0 | elliptic cylinder | 45 | 0.5 | 1.3 | 785 | 15 | 0 | 20 |
| Example 10 | 1.0 | elliptic cylinder | 45 | 0.4 | 1.1 | 785 | 15 | 0 | 30 |
| Example 11 | 1.0 | elliptic cylinder | 45 | 0.4 | 1.5 | 785 | 15 | 0 | 30 |
| Example 12 | 1.0 | elliptic cylinder | 45 | 0.4 | 1.3 | 71 | 15 | 0 | 40 |
| Example 13 | 1.0 | elliptic cylinder | 45 | 0.4 | 1.3 | 1500 | 15 | 0 | 20 |
| Example 14 | 1.0 | elliptic cylinder | 45 | 0.4 | 1.3 | 785 | 10 | 0 | 30 |
| Example 15 | 1.0 | elliptic cylinder | 45 | 0.4 | 1.3 | 785 | 20 | 0 | 15 |
| Example 16 | 1.0 | hexagonal prism | 45 | 0.4 | 1.3 | 785 | 15 | 0 | 15 |
| Example 17 | 1.0 | quadrangular prism | 45 | 0.4 | 1.3 | 785 | 15 | 0 | 15 |
| Example 18 | 1.0 | elliptic cylinder | 10 | 0.4 | 1.3 | 894 | 15 | 0 | 40 |
| Example 19 | 1.0 | elliptic cylinder | 20 | 0.4 | 1.3 | 823 | 15 | 0 | 25 |
| Example 20 | 1.0 | elliptic cylinder | 30 | 0.4 | 1.3 | 800 | 15 | 0 | 15 |
| Example 21 | 1.0 | elliptic cylinder | 60 | 0.4 | 1.3 | 779 | 15 | 0 | 15 |
| Example 22 | 1.0 | elliptic cylinder | 70 | 0.4 | 1.3 | 777 | 15 | 0 | 25 |
| Example 23 | 1.0 | elliptic cylinder | 80 | 0.4 | 1.3 | 775 | 15 | 0 | 40 |
| Example 24 | 1.0 | elliptic cylinder | 45 | 0.4 | 1.3 | 785 | 150 | 0 | 13 |
| Example 25 | 1.0 | elliptic cylinder | 45 | 0.4 | 1.3 | 785 | 300 | 0 | 11 |
| Example 26 | 1.0 | elliptic cylinder | 45 | 0.4 | 1.3 | 785 | 600 | 0 | 8 |
| Example 27 | 0.1 | elliptic cylinder | 45 | 0.03 | 0.13 | 785 | 15 | 0 | 32 |
| Example 28 | 0.1 | elliptic cylinder | 45 | 0.05 | 0.13 | 785 | 15 | 0 | 33 |
| Example 29 | 0.1 | elliptic cylinder | 45 | 0.04 | 0.11 | 785 | 15 | 0 | 35 |
| Example 30 | 0.1 | elliptic cylinder | 45 | 0.04 | 0.15 | 785 | 15 | 0 | 35 |
| Example 31 | 1.5 | elliptic cylinder | 45 | 0.45 | 1.95 | 785 | 15 | 0 | 35 |
| Example 32 | 1.5 | elliptic cylinder | 45 | 0.75 | 1.95 | 785 | 15 | 0 | 35 |
| Example 33 | 1.5 | elliptic cylinder | 45 | 0.6 | 1.65 | 785 | 15 | 0 | 40 |
| Example 34 | 1.5 | elliptic cylinder | 45 | 0.6 | 2.25 | 785 | 15 | 0 | 40 |

TABLE 2

| | Number-average particle size P of inorganic fine particles | Shape | Angle θ | Depth Rdv | Minor-axis diameter Lpc | Major-axis diameter Rpc | Number | Number of white streaks | Maximum width of scratches |
|---|---|---|---|---|---|---|---|---|---|
| Comparative Example 1 | 1.0 | — | — | — | — | — | — | 5 | — |
| Comparative Example 2 | 1.0 | elliptic cylinder | 0 | 0.4 | 1.3 | 1500 | 15 | 3 | 50 |
| Comparative Example 3 | 1.0 | elliptic cylinder | 3 | 0.4 | 1.3 | 1500 | 15 | 2 | 50 |
| Comparative Example 4 | 1.0 | elliptic cylinder | 87 | 0.4 | 1.3 | 50 | 15 | 2 | 50 |
| Comparative Example 5 | 1.0 | elliptic cylinder | 90 | 0.4 | 1.3 | 50 | 15 | 3 | 50 |
| Comparative Example 6 | 1.0 | elliptic cylinder | 45 | 0.2 | 1.3 | 785 | 15 | 3 | 50 |
| Comparative Example 7 | 1.0 | elliptic cylinder | 45 | 0.6 | 1.3 | 785 | 15 | 3 | 50 |
| Comparative Example 8 | 1.0 | elliptic cylinder | 45 | 0.4 | 1.0 | 785 | 15 | 2 | 50 |
| Comparative Example 9 | 1.0 | elliptic cylinder | 45 | 0.4 | 1.6 | 785 | 15 | 2 | 50 |
| Comparative Example 10 | 1.0 | elliptic cylinder | 5 | 0.4 | 1.3 | 40 | 15 | 2 | 50 |
| Comparative Example 11 | 1.0 | elliptic cylinder | 85 | 0.4 | 1.3 | 2000 | 15 | 2 | 50 |
| Comparative Example 12 | 1.0 | elliptic cylinder | 45 | 0.4 | 1.3 | 785 | 3 | 4 | 50 |
| Comparative Example 13 | 1.0 | elliptic cylinder | 45 | 0.4 | 1.3 | 785 | 8 | 2 | 50 |
| Comparative Example 14 | 0.1 | elliptic cylinder | 45 | 0.02 | 0.13 | 785 | 15 | 3 | 50 |

TABLE 2-continued

| | Number-average particle size P of inorganic fine particles | Shape | Angle θ | Depth Rdv | Minor-axis diameter Lpc | Major-axis diameter Rpc | Number | Number of white streaks | Maximum width of scratches |
|---|---|---|---|---|---|---|---|---|---|
| Comparative Example 15 | 0.1 | elliptic cylinder | 45 | 0.06 | 0.13 | 785 | 15 | 3 | 50 |
| Comparative Example 16 | 0.1 | elliptic cylinder | 45 | 0.04 | 0.1 | 785 | 15 | 2 | 50 |
| Comparative Example 17 | 0.1 | elliptic cylinder | 45 | 0.04 | 0.16 | 785 | 15 | 2 | 50 |
| Comparative Example 18 | 1.5 | elliptic cylinder | 45 | 0.3 | 1.95 | 785 | 15 | 3 | 50 |
| Comparative Example 19 | 1.5 | elliptic cylinder | 45 | 0.9 | 1.95 | 785 | 15 | 3 | 50 |
| Comparative Example 20 | 1.5 | elliptic cylinder | 45 | 0.6 | 1.5 | 785 | 15 | 2 | 50 |
| Comparative Example 21 | 1.5 | elliptic cylinder | 45 | 0.6 | 2.4 | 785 | 15 | 2 | 50 |
| Comparative Example 22 | 1.0 | elliptic cylinder | 5 | 0.4 | 1.3 | 500 | 15 | 2 | 50 |
| Comparative Example 23 | 1.0 | elliptic cylinder | 5 | 0.4 | 1.3 | 2000 | 15 | 2 | 50 |
| Comparative Example 24 | 1.0 | elliptic cylinder | 85 | 0.4 | 1.3 | 40 | 15 | 2 | 50 |
| Comparative Example 25 | 1.0 | elliptic cylinder | 45 | 0.4 | 1.3 | 60 | 15 | 2 | 50 |
| Comparative Example 26 | 1.0 | elliptic cylinder | 45 | 0.4 | 1.3 | 2000 | 15 | 2 | 50 |

The "Shape" in Tables 1 and 2 refers to the shapes of depressed portions. The "Angle θ" refers to the angle θ of each of depressed portions formed in the surfaces of the electrophotographic photosensitive members (the angle θ being formed between the direction of the major-axis of each of the depressed portions and the direction of movement of the surface of an electrophotographic photosensitive member). The "Depth Rdv" refers to the depth Rdv of each of the depressed portions formed in the surfaces of the electrophotographic photosensitive members. The "Minor-axis diameter Lpc" refers to the minor-axis diameter Lpc of each of the depressed portions formed in the surfaces of the electrophotographic photosensitive members. The "Major-axis diameter Rpc" refers to the major-axis diameter Rpc of each of the depressed portions formed in the surfaces of the electrophotographic photosensitive members. The "Number" refers to the number of depressed portions per unit area of 1 $cm^2$ in the surfaces of the electrophotographic photosensitive members. The units for "Number-average particle size P of inorganic fine particles", "Depth Rdv", "Minor-axis diameter Lpc", and "Major-axis diameter Rpc" are [μm]. The unit for "Angle θ" is [°].

In each Example, all the depressed portions formed in the surface of an electrophotographic photosensitive member were the same in terms of shape, depth Rdv, minor-axis diameter Lpc, major-axis diameter Rpc, and angle θ. Alternatively, two or more types of depressed portions that are different from each other in terms of at least one among shape, depth Rdv, minor-axis diameter Lpc, major-axis diameter Rpc, angle θ, and the like may be formed in the surface of an electrophotographic photosensitive member. In this case, as long as each of the depressed portions satisfies the above-described conditions in terms of depth Rdv, minor-axis diameter Lpc, major-axis diameter Rpc, and angle θ, advantages similar to those in Examples can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-312377, filed Dec. 8, 2008, which is hereby incorporated by reference herein in its entirety.

The invention claimed is:

1. An electrophotographic apparatus comprising:

an electrophotographic photosensitive member including a support and a photosensitive layer formed on the support;

a developing unit configured to develop an electrostatic latent image formed on a surface of the electrophotographic photosensitive member with a toner containing, as an external additive, inorganic fine particles having a number-average particle size (P[μm]) of 0.1 μm or more and 1.5 μm or less; and a cleaning unit configured to remove untransferred toner remaining on the surface of the electrophotographic photosensitive member with a cleaning blade, wherein, depressed portions which are independent from one another, are formed in the surface of the electrophotographic photosensitive member at a density of 10 or more of the depressed portions per unit area of 1 $cm^2$, and each of the depressed portions satisfies the following conditions;

Conditions each of the depressed portions satisfies the following relationships where a depth of each of the depressed portions is defined as Rdv[μm], a minor-axis diameter of each of the depressed portions is defined as Lpc[μm], a major-axis diameter of each of the depressed portions is defined as Rpc[μm], and an angle formed between a direction of the major-axis of each of the depressed portions and a direction of movement of the surface of the electrophotographic photosensitive member is defined as θ[°]:

$$5[°] \leq \theta[°] \leq 85[°],$$

$$0.3 \times P[\mu m] \leq Rdv[\mu m] \leq 0.5 \times P[\mu m],$$

$1.1 \times P[\mu m] \leq Lpc[\mu m] \leq 1.5 \times P[\mu m]$, and $50/\sin\theta[\mu m] \leq Rpc[\mu m] \leq 1500[\mu m]$.

2. The electrophotographic apparatus according to claim 1, wherein the depressed portions are formed in the surface of the electrophotographic photosensitive member at a density of 20 or more of the depressed portions per unit area of 1 $cm^2$.

3. A process cartridge detachably mountable to a main body of an electrophotographic apparatus, the process cartridge comprising:

an electrophotographic photosensitive member including a support and a photosensitive layer formed on the support;

a developing unit configured to develop an electrostatic latent image formed on a surface of the electrophotographic photosensitive member with a toner containing, as an external additive, inorganic fine particles having a number-average particle size (P[μm]) of 0.1 μm or more and 1.5 μm or less; and a cleaning unit configured to remove untransferred toner remaining on the surface of the electrophotographic photosensitive member with a cleaning blade, wherein, depressed portions which are independent from one another, are formed in the surface of the electrophotographic photosensitive member at a density of 10 or more of the depressed portions per unit area of 1 $cm^2$, and each of the depressed portions satisfies the following conditions;

Conditions each of the depressed portions satisfies the following relationships where a depth of each of the depressed portions is defined as Rdv[μm], a minor-axis diameter of each of the depressed portions is defined as Lpc[μm], a major-axis diameter of each of the depressed portions is defined as Rpc[μm], and an angle formed between a direction of a major-axis of each of the depressed portions and a direction of movement of the surface of the electrophotographic photosensitive member is defined as θ[°]:

$5[°] \leq \theta[°] \leq 85[°]$, $0.3 \times P[\mu m] \leq Rdv[\mu m] \leq 0.5 \times P[\mu m]$, $1.1 \times P[\mu m] \leq Lpc[\mu m] \leq 1.5 \times P[\mu m]$, and $50/\sin\theta[\mu m] \leq Rpc[\mu m] \leq 1500[\mu m]$.

4. The process cartridge according to claim 3, wherein the depressed portions are formed in the surface of the electrophotographic photosensitive member at a density of 20 or more of the depressed portions per unit area of 1 $cm^2$.

* * * * *